US010369675B2

(12) United States Patent
Matsuo

(10) Patent No.: US 10,369,675 B2
(45) Date of Patent: Aug. 6, 2019

(54) CMP APPARATUS HAVING POLISHING PAD SURFACE PROPERTY MEASURING DEVICE

(71) Applicant: EBARA CORPORATION, Tokyo (JP)

(72) Inventor: Hisanori Matsuo, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 74 days.

(21) Appl. No.: 15/541,456

(22) PCT Filed: Jan. 7, 2016

(86) PCT No.: PCT/JP2016/050377
§ 371 (c)(1),
(2) Date: Jul. 3, 2017

(87) PCT Pub. No.: WO2016/111335
PCT Pub. Date: Jul. 14, 2016

(65) Prior Publication Data

US 2018/0015590 A1 Jan. 18, 2018

(30) Foreign Application Priority Data

Jan. 7, 2015 (JP) ..... 2015-001881

(51) Int. Cl.

| | |
|---|---|
| ***B24B 37/00*** | (2012.01) |
| ***B24B 37/04*** | (2012.01) |
| ***B24B 49/12*** | (2006.01) |
| ***B24B 49/18*** | (2006.01) |
| ***B24B 53/00*** | (2006.01) |

(Continued)

(52) U.S. Cl.
CPC ..... *B24B 37/005* (2013.01); *B24B 37/00* (2013.01); *B24B 37/04* (2013.01); *B24B 49/12* (2013.01);

(Continued)

(58) Field of Classification Search
CPC ..... B24B 37/00; B24B 37/005; B24B 37/04; B24B 49/12; B24B 49/18; B24B 53/00; B24B 53/017; B24B 53/02
See application file for complete search history.

(56) References Cited

U.S. PATENT DOCUMENTS 6,896,583 B2 5/2005 Rodriquez et al.
6,910,947 B2 * 6/2005 Paik ..... B24B 37/013 451/21

(Continued)

FOREIGN PATENT DOCUMENTS

JP S63-153821 A 6/1988
JP H06-147838 A 5/1994

(Continued)

OTHER PUBLICATIONS

International Patent Application No. PCT/JP2016/050377; Int'l Search Report; dated Mar. 15, 2016.

*Primary Examiner* — Timothy V Eley
(74) *Attorney, Agent, or Firm* — Baker & Hostetler LLP

(57) ABSTRACT

The present invention relates to a CMP apparatus having a polishing pad surface property measuring device for measuring surface properties such as surface topography or surface condition of a polishing pad used for polishing a substrate such as a semiconductor wafer. The CMP apparatus includes a polishing pad surface property measuring device (30) configured to apply a laser beam to a surface of a polishing pad (2) and to receive reflected light from the polishing pad to obtain reflection intensity in each reflection angle, a processor (40) configured to perform a Fourier transform on a reflection intensity distribution obtained by the measuring device to obtain a spatial wavelength spectrum of the surface of the polishing pad and to obtain surface properties of the polishing pad by numerical analysis, a dressing control unit (23) configured to determine dressing (Continued)

conditions of the polishing pad (2) by a closed loop control based on the surface properties of the polishing pad obtained by the processor, and a dressing apparatus (20) configured to dress the polishing pad based on the dressing conditions determined by the dressing control unit.

20 Claims, 8 Drawing Sheets

(51) Int. Cl. *B24B 53/02* (2012.01) *B24B 37/005* (2012.01) *B24B 53/017* (2012.01)

(52) U.S. Cl.
CPC ..... *B24B 49/18* (2013.01); *B24B 53/00* (2013.01); *B24B 53/017* (2013.01); *B24B 53/02* (2013.01)

(56) References Cited

U.S. PATENT DOCUMENTS

| | | | | |
|---|---|---|---|---|
| 8,932,883 | B2 * | 1/2015 | Matsuo | G01N 21/4738 438/16 |
| 9,669,515 | B2 * | 6/2017 | Matsuo | B24B 49/12 |
| 2013/0217306 | A1 | 8/2013 | Wu et al. | |
| 2016/0184960 | A1 * | 6/2016 | Matsuo | B24B 37/005 451/5 |

FOREIGN PATENT DOCUMENTS

| | | | |
|---|---|---|---|
| JP | 2001-223190 | A | 8/2001 |
| JP | 2012-137484 | A | 7/2012 |
| JP | 2014-172153 | A | 9/2014 |
| JP | 2014-172154 | A | 9/2014 |

* cited by examiner

CMP APPARATUS HAVING POLISHING PAD SURFACE PROPERTY MEASURING DEVICE

TECHNICAL FIELD

The present invention relates to a CMP apparatus having a polishing pad surface property measuring device for measuring surface properties such as surface topography or surface condition of a polishing pad used for polishing a substrate such as a semiconductor wafer.

BACKGROUND ART

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, using a polishing apparatus, while a polishing liquid containing abrasive particles such as silica ($SiO_2$) or ceria ($CeO_2$) therein is supplied onto a polishing pad, a substrate such as a semiconductor wafer is brought into sliding contact with the polishing pad, so that the substrate is polished.

The polishing apparatus (CMP apparatus) for performing the above CMP (chemical mechanical polishing) process includes a polishing table having a polishing pad, and a substrate holding device, which is referred to as a carrier or a top ring, for holding a substrate such as a semiconductor wafer. By using such a CMP apparatus, the substrate is held and pressed against the polishing pad under a predetermined pressure by the substrate holding device, thereby polishing an insulating film, a metal film or the like on the substrate.

After one or more substrates have been polished, abrasive particles or ground-off particles of the substrate are attached to the surface of the polishing pad, and surface configuration or surface condition of the polishing pad is changed, resulting in deterioration in polishing performance. Therefore, as the substrates are repeatedly polished by the same polishing pad, a polishing rate is lowered and nonuniform polishing action is caused. Thus, dressing (conditioning) of the polishing pad is performed by using a dresser to regenerate the surface topography or surface condition of the polishing pad which has deteriorated.

In general, the CMP apparatus does not have a function for measuring surface properties such as surface topography or surface condition of the polishing pad directly. Therefore, there have been attempts to predict surface properties of the polishing pad by measuring the friction between the polishing pad and the substrate or between the polishing pad and the dresser indirectly. In this case, as a means for measuring the friction indirectly, it is common practice to reference a load torque of a motor for rotating the polishing table to which the polishing pad is attached.

CITATION LIST

Patent Literature

Patent document 1: U.S. Patent Application Publication No. US 2013/0217306

Patent document 2: Japanese laid-open patent publication No. 2014-172153

SUMMARY OF INVENTION

Technical Problem

As described above, in general, the surface properties of the polishing pad cannot be measured on the CMP apparatus, and thus the torque of the motor is measured by rotating the polishing table in order to obtain measured quantity related to the pad surface properties. However, the torque of the motor is affected not only by the pad surface properties but also by surface condition of the substrate such as a wafer, surface condition of the dresser, and installation condition of the rotating equipment, and therefore it is impossible to grasp the pad surface properties accurately. Because the pad surface properties are one of factors to determine the CMP performance, if the pad surface properties cannot be measured, then the CMP performance cannot be controlled arbitrarily.

The present invention has been made in view of the above circumstances. It is therefore an object of the present invention to provide a CMP apparatus, having a polishing pad surface property measuring device which can measure surface properties of a polishing pad that reflect CMP performance, for polishing a substrate or dressing the polishing pad under operating conditions that are established based on measured result of the surface properties of the polishing pad.

Solution to Problem

In order to achieve the above object, according to a first aspect of the present invention, there is provided a CMP apparatus comprising: a polishing pad surface property measuring device configured to apply a laser beam to a surface of a polishing pad and to receive reflected light from the polishing pad to obtain reflection intensity in each reflection angle; a processor configured to perform a Fourier transform on a reflection intensity distribution obtained by the polishing pad surface property measuring device to obtain a spatial wavelength spectrum of the surface of the polishing pad, and to perform numerical analysis on the spatial wavelength spectrum to obtain surface properties of the polishing pad; a dressing control unit configured to determine dressing conditions of the polishing pad by a closed loop control based on the surface properties of the polishing pad obtained by the processor; and a dressing apparatus configured to dress the polishing pad based on the dressing conditions determined by the dressing control unit.

In a preferred aspect of the present invention, the determination of the dressing conditions comprises: obtaining a difference between a measured surface property value of the pad and a preset desired surface property value of the pad, as a desired surface property variation of the pad; and assigning the desired surface property variation of the pad to a regression equation prepared by obtaining in advance a relationship between a variation of at least one of a dressing load, a dresser rotational speed, a polishing pad rotational speed, and a dresser swinging speed and a surface property variation of the pad to determine at least one of the dressing load, the dresser rotational speed, the polishing pad rotational speed, and the dresser swinging speed.

In a preferred aspect of the present invention, the numerical analysis for obtaining the surface properties of the polishing pad performed by the processor comprises dividing a sum of the reflection intensity of a predetermined spatial wavelength range by a sum of the reflection intensity of a wider spatial wavelength range.

In a preferred aspect of the present invention, the polishing pad surface property measuring device comprises at least a laser light source, a light emitter and a light receiver.

In a preferred aspect of the present invention, the polishing pad surface property measuring device further comprises at least one of a mirror, an ND filter, a polarizer, a bandpass filter which allows transmission of only light within ±5 nm with respect to a wavelength of the laser beam of the light source, and an optical fiber.

In a preferred aspect of the present invention, the light receiver comprises a linear or planar CCD element or CMOS element having a size capable of receiving fourth-order diffracted light at the highest or seventh-order diffracted light at the highest of the laser beam reflected from the polishing pad.

In a preferred aspect of the present invention, the laser beam applied to the surface of the polishing pad is s-polarized.

In a preferred aspect of the present invention, the dressing control unit is configured to adjust at least one of a dressing load, a polishing pad rotational speed, a dresser rotational speed, and a dresser swinging speed.

In a preferred aspect of the present invention, irradiation of the laser beam is performed by swinging the light source to adjust an incident angle of the laser beam to the surface of the polishing pad.

According to a second aspect of the present invention, there is provided a CMP apparatus comprising: a polishing pad surface property measuring device configured to apply a laser beam to a surface of a polishing pad and to receive reflected light from the polishing pad to obtain reflection intensity in each reflection angle; a processor configured to perform a Fourier transform on a reflection intensity distribution obtained by the polishing pad surface property measuring device to obtain a spatial wavelength spectrum of the surface of the polishing pad, and to perform numerical analysis on the spatial wavelength spectrum to obtain surface properties of the polishing pad; and a display unit configured to display at least one of a state of the dresser and a state of the polishing pad after comparing the surface properties of the polishing pad obtained by the processor and a preset surface property value of the pad.

In a preferred aspect of the present invention, the state of the dresser is one of an alarm representing life of the dresser and a poor performance state of the dresser.

In a preferred aspect of the present invention, the state of the polishing pad is presence or absence of an abnormality of the surface properties of the polishing pad.

According to a third aspect of the present invention, there is provided a CMP apparatus comprising: a polishing pad surface property measuring device configured to apply a laser beam to a surface of a polishing pad and to receive reflected light from the polishing pad to obtain reflection intensity in each reflection angle; a processor configured to perform a Fourier transform on a reflection intensity distribution obtained by the polishing pad surface property measuring device to obtain a spatial wavelength spectrum of the surface of the polishing pad, and to perform numerical analysis on the spatial wavelength spectrum to obtain surface properties of the polishing pad; and a display unit configured to display at least one of a state of the dresser and a state of the polishing pad based on the surface properties of the polishing pad obtained by the processor.

In a preferred aspect of the present invention, the state of the dresser is dressing capability of the dresser.

In a preferred aspect of the present invention, the state of the polishing pad is a surface property value of the polishing pad.

According to a fourth aspect of the present invention, there is provided a CMP apparatus comprising: a polishing pad surface property measuring device configured to apply a laser beam to a surface of a polishing pad and to receive reflected light from the polishing pad to obtain reflection intensity in each reflection angle; a processor configured to perform a Fourier transform on a reflection intensity distribution obtained by the polishing pad surface property measuring device to obtain a spatial wavelength spectrum of the surface of the polishing pad, and to perform numerical analysis on the spatial wavelength spectrum to obtain surface properties of the polishing pad; and an abnormality judgement unit configured to judge an abnormality of the surface properties of the polishing pad when a surface property value of the polishing pad obtained by the processor is compared with a preset range of the surface property value of the pad and falls outside the preset range.

In a preferred aspect of the present invention, when the abnormality is judged by the abnormality judgement unit, a display unit issues an alarm of the abnormality.

According to the present invention, there is provided a computer-readable recording medium which records a program for causing a CMP apparatus to perform predetermined operations, the recording medium which records the program causing a computer to perform: a step for applying a laser beam to a surface of a polishing pad; a step for receiving reflected light from the polishing pad; a step for taking in information of the received light; a step for obtaining reflection intensity in each reflection angle obtained from the taken-in information; a step for creating a reflection intensity distribution by performing the step for applying the laser beam, the step for receiving the light, the step for taking in the information and the step for obtaining the reflection intensity for predetermined time; or a step for creating a reflection intensity distribution by repeating the step for applying the laser beam, the step for receiving the light, the step for taking in the information and the step for obtaining the reflection intensity a predetermined number of times; a step for obtaining a spatial wavelength spectrum of the surface of the polishing pad by performing a Fourier transform on the reflection intensity distribution; a step for performing numerical analysis from the spatial wavelength spectrum; and a step for obtaining surface properties of the polishing pad from the numerical analysis.

In a preferred aspect of the present invention, the computer-readable recording medium is characterized in that the recording medium records the program causing the computer to perform further: a step for comparing the obtained surface property value and a preset surface property value of the pad; and a step for displaying at least one of a state of the dresser or a state of the polishing pad from the compared result.

In a preferred aspect of the present invention, the computer-readable recording medium is characterized in that the recording medium records the program causing the computer to perform further: a step for determining dressing conditions of the polishing pad by a closed loop control based on the obtained surface property value.

In a preferred aspect of the present invention, the computer-readable recording medium is characterized in that the step for determining the dressing conditions comprises: a step for obtaining a difference between the surface property value obtained from the numerical analysis and a preset desired surface property value of the pad, as a desired surface property variation of the pad; a step for assigning the desired surface property variation of the pad to a predetermined regression equation which has been obtained and stored in advance; and a step for selecting optimum dressing conditions from the result of the above assignment.

In a preferred aspect of the present invention, the computer-readable recording medium is characterized in that the recording medium records the program causing the computer to perform further: a step for adjusting an incident angle of the laser beam to the polishing pad before the step for applying the laser beam.

Advantageous Effects of Invention

The present invention offers the following advantages:

(1) Because the CMP apparatus has a function for directly measuring the surface properties of the polishing pad which determine the CMP performance, dressing for keeping the surface properties of the polishing pad to a desired predetermined value can be realized, and an abnormality of the dresser or the polishing pad can be notified, thus contributing to the prevention of the CMP process in an abnormal state.

(2) The surface properties of the polishing pad can be kept at all times in a state required to ensure the CMP performance by changing dressing conditions depending on a change in the surface properties of the polishing pad.

(3) The cost of consumable materials can be reduced because the polishing pad and the dresser can be used up until the end of their lives.

DESCRIPTION OF EMBODIMENTS

Figure 1:
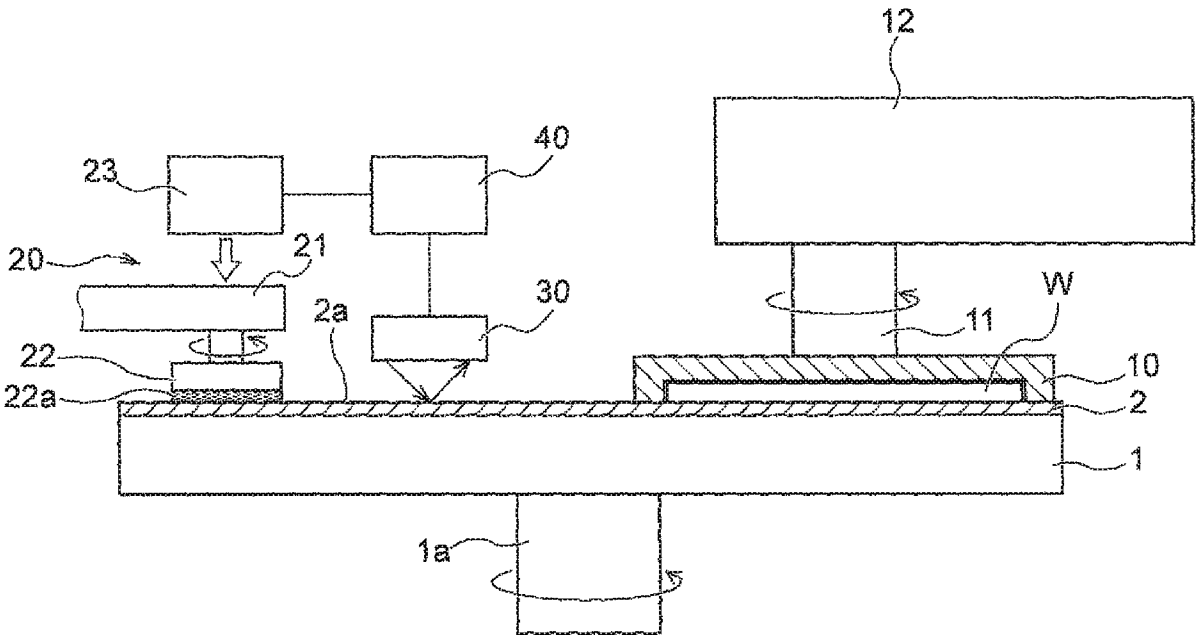
FIG. 1 is a schematic view showing a first embodiment of a CMP apparatus having a polishing pad surface property measuring device according to the present invention.

A CMP apparatus having a polishing pad surface property measuring device according to embodiments of the present invention will be described below with reference to FIGS. 1 through 12. Identical or corresponding parts are denoted by identical reference numerals in FIGS. 1 through 12 and will not be described in duplication.

FIG. 1 is a schematic view showing a first embodiment of the CMP apparatus having a polishing pad surface property measuring device according to the present invention. As shown in FIG. 1, the CMP apparatus comprises a polishing table 1, and a carrier 10 for holding a substrate W such as a semiconductor wafer as an object to be polished and pressing the substrate against a polishing pad on the polishing table. The polishing table 1 is coupled via a table shaft 1*a* to a polishing table rotating motor (not shown) disposed below the polishing table 1. Thus, the polishing table 1 is rotatable about the table shaft 1*a*. A polishing pad 2 is attached to an upper surface of the polishing table 1. An upper surface of the polishing pad 2 constitutes a polishing surface 2*a* for polishing the substrate W. The polishing pad 2 comprising SUBA 800, IC-1000, IC-1000/SUBA400 (two-layer cloth) or the like manufactured by the Dow Chemical Company is used. The SUBA 800 is non-woven fabrics bonded by urethane resin. The IC-1000 comprises a pad composed of hard polyurethane foam and having a large number of fine holes (pores) formed in its surface, and is also called a perforated pad. A polishing liquid supply nozzle (not shown) is provided above the polishing table 1 to supply a polishing liquid (slurry) onto the polishing pad 2 on the polishing table 1.

The carrier 10 is connected to a shaft 11, and the shaft 11 is vertically movable with respect to a carrier arm 12. When the shaft 11 moves vertically, the carrier 10 is lifted and lowered as a whole for positioning with respect to the carrier arm 12. The shaft 11 is configured to be rotated by driving a motor (not shown). The carrier 10 is rotated about an axis of the shaft 11.

As shown in FIG. 1, the carrier 10 is configured to hold the substrate W such as a semiconductor wafer on its lower surface. The carrier arm 12 is configured to be pivotable, and thus the carrier 10, which holds the substrate W on its lower surface, is movable from a position at which the carrier 10 receives the substrate to a position above the polishing table 1 by pivotable movement of the carrier arm 12. Then, the carrier 10 holds the substrate W on its lower surface and presses the substrate W against the surface (polishing surface) of the polishing pad 2. At this time, while the polishing table 1 and the carrier 10 are respectively rotated, a polishing liquid (slurry) is supplied onto the polishing pad 2 from the polishing liquid supply nozzle provided above the polishing table 1. The polishing liquid containing silica ($SiO_2$) or ceria ($CeO_2$) as abrasive particles is used. In this manner, while the polishing liquid is supplied onto the polishing pad 2, the substrate W is pressed against the polishing pad 2 and is moved relative to the polishing pad 2 to polish an insulating film, a metal film or the like on the substrate. Examples of the insulating film include $SiO_2$, and examples of the metal film include a Cu film, a W film, a Ta film and a Ti film.

As shown in FIG. 1, the CMP apparatus has a dressing apparatus 20 for dressing the polishing pad 2. The dressing apparatus 20 comprises a dresser arm 21, and a dresser 22 which is rotatably attached to a forward end of the dresser arm 21. The lower part of the dresser 22 comprises a dressing member 22*a*, and the dressing member 22*a* has a circular dressing surface. Hard particles are fixed to the dressing surface by electrodeposition or the like. Examples of the hard particles include diamond particles, ceramic particles and the like. A motor (not shown) is provided in the dresser arm 21, and the dresser 22 is rotated by the motor. The dresser arm 21 is coupled to a lifting and lowering mechanism (not shown), and the dresser arm 21 is lowered by the lifting and lowering mechanism to allow the dressing member 22*a* to be pressed against the polishing surface 2*a* of the polishing pad 2. The dressing apparatus 20 is connected to a dressing control unit 23, and dressing conditions are controlled by the dressing control unit 23.

As shown in FIG. 1, the CMP apparatus has a polishing pad surface property measuring device 30 for measuring surface properties such as surface topography or surface condition of the polishing pad 2. The polishing pad surface property measuring device 30 is configured to apply a laser beam to the polishing pad 2 and to receive reflected light that is reflected by the surface of the polishing pad 2, thereby measuring surface properties of the pad. The polishing pad surface property measuring device 30 is connected to a processor 40.

In the CMP apparatus configured as shown in FIG. 1, the distribution of reflected light from the pad surface obtained in the polishing pad surface property measuring device 30 is arithmetically calculated to obtain a surface property value of the pad in the processor 40 and the calculated result is transferred to the dressing control unit 23. In the dressing control unit 23, dressing conditions are determined based on the received surface property value of the pad. The dressing apparatus 20 performs the operations according to the dressing conditions determined by the dressing control unit 23, thereby dressing the pad surface by the dresser 22.

Figure 2:
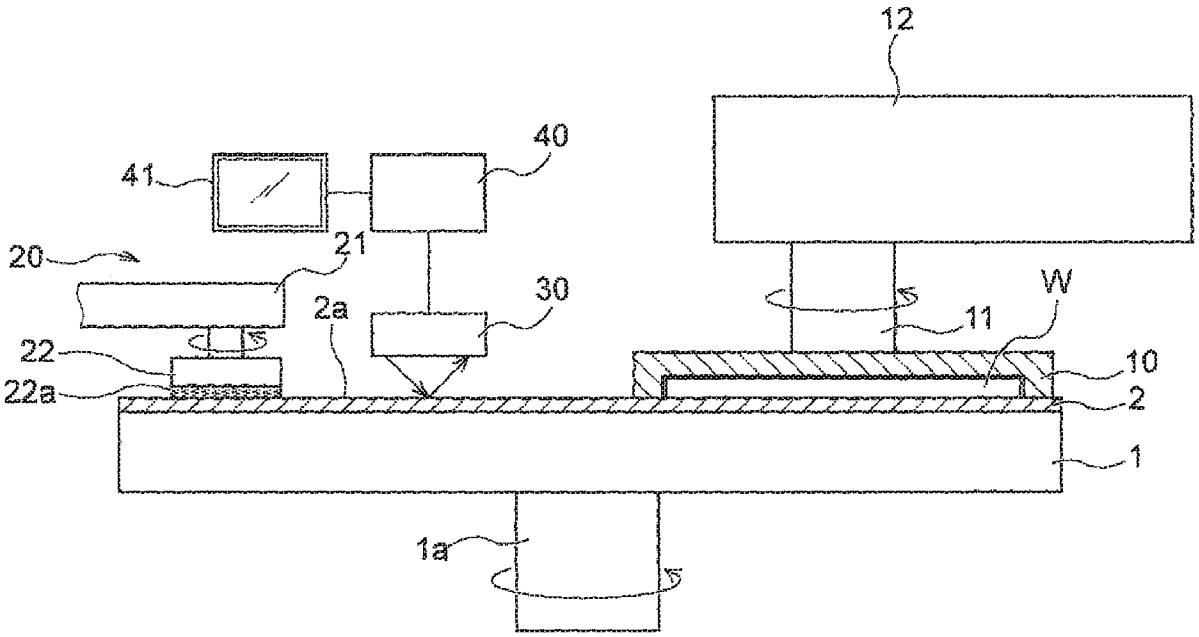
FIG. 2 is a schematic view showing a second embodiment of the CMP apparatus having a polishing pad surface property measuring device according to the present invention.

FIG. 2 is a schematic view showing a second embodiment of the CMP apparatus having a polishing pad surface property measuring device according to the present invention. The CMP apparatus shown in FIG. 2 has a polishing unit comprising a polishing table 1 to which a polishing pad 2 is attached, a carrier 10, and the like, and a dressing apparatus 20, as with the CMP apparatus shown in FIG. 1. Further, the CMP apparatus shown in FIG. 2 has a polishing pad surface property measuring device 30 and a processor 40, as with the CMP apparatus shown in FIG. 1. The processor 40 is connected to a display unit 41.

In the CMP apparatus configured as shown in FIG. 2, the distribution of reflected light from the pad surface obtained in the polishing pad surface property measuring device 30 is arithmetically calculated to obtain a surface property value of the pad in the processor 40 and the calculated result is displayed in the display unit 41.

Figure 3:
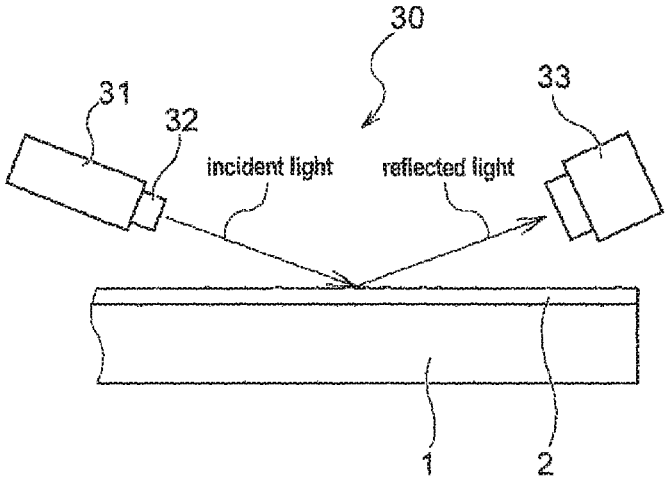
FIG. 3 is a schematic front elevational view showing a first embodiment of the polishing pad surface property measuring device shown in FIGS. 1 and 2.

FIG. 3 is a schematic front elevational view showing a first embodiment of the polishing pad surface property measuring device 30 shown in FIGS. 1 and 2. As shown in FIG. 3, the polishing pad surface property measuring device 30 includes a light source 31 for emitting a laser beam, a light emitter 32 for leading the laser beam emitted from the light source 31 to the surface of the polishing pad 2 on the polishing table 1, and a light receiver 33 for receiving reflected light that is reflected by the surface of the polishing pad 2. Therefore, the laser beam emitted from the light source 31 is led to the surface of the polishing pad 2 through the light emitter 32, and reflected light that is reflected by the surface of the polishing pad 2 is received by the light receiver 33. The light receiver 33 is connected to the processor 40 (see FIGS. 1 and 2).

Figure 4:
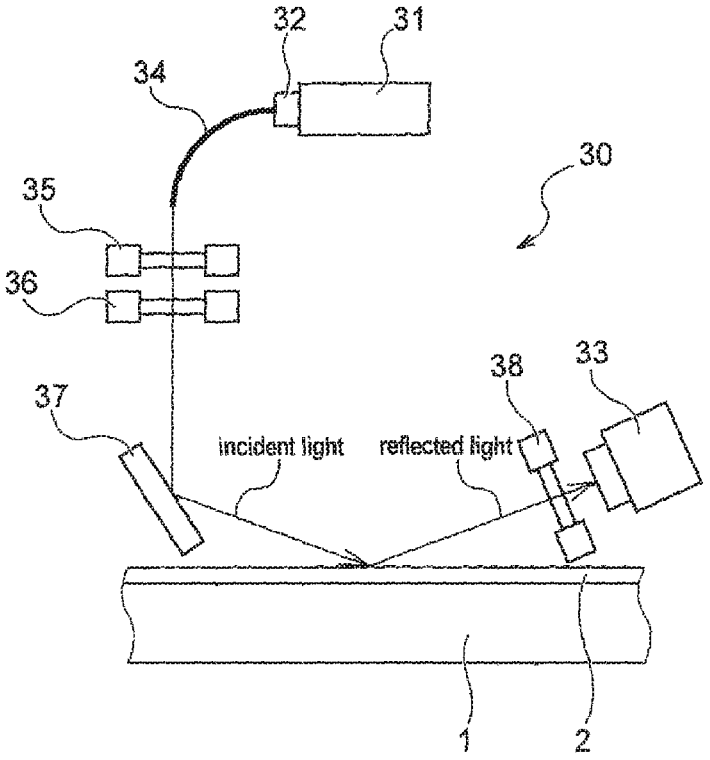
FIG. 4 is a schematic front elevational view showing a second embodiment of the polishing pad surface property measuring device shown in FIGS. 1 and 2.

FIG. 4 is a schematic front elevational view showing a second embodiment of the polishing pad surface property measuring device 30 shown in FIGS. 1 and 2. As shown in FIG. 4, the polishing pad surface property measuring device 30 includes a light source 31 for emitting a laser beam, an optical fiber 34 for leading the laser beam emitted from the light source 31 downwardly in a substantially vertical direction through the light emitter 32, and a polarizer 35, an ND filter (neutral density filter) 36 and a mirror 37 which are arranged in series below the optical fiber 34. Further, a bandpass filter 38 is disposed before the light receiver 33 on an optical path of the reflected light that is reflected by the surface of the polishing pad 2. Therefore, the laser beam emitted from the optical fiber 34 is s-polarized by the polarizer 35, and is then adjusted in light quantity by the ND filter 36 and applied to the mirror 37. Then, the laser beam is reflected by the mirror 37 to change its optical path, and is then applied to the surface of the polishing pad 2. The reflected light that is reflected by the surface of the polishing pad 2 enters the bandpass filter 38 which allows only light having a particular wavelength range to pass therethrough, and the reflected light having the particular wavelength range is received by the light receiver 33.

The light receiver 33 shown in FIGS. 3 and 4 comprises a linear or planar CCD element or CMOS element whose size can receive fourth-order diffracted light at the highest or seventh-order diffracted light at the highest of the laser beam reflected from the pad. The laser beam that has been applied to the pad surface is reflected not only at a regular angle (regular reflection) but also at a wide angle through diffraction phenomenon depending on the surface properties of the pad. Specifically, the light receiver 33 receives the laser beam that has not only a regular reflection component but also reflection components reflected at a wide angle, and the received laser beam is analyzed to obtain information of the surface properties of the pad. A linear or planar light receiving element is necessary for receiving the laser beam reflected at the wide angle. Because it is known that the surface properties of the pad which determine the CMP performance is included in, preferably seventh-order diffracted light at the highest, practically fourth-order diffracted light at the highest, the light receiving element whose size can receive the diffracted light of this range is necessary.

Next, operation of the CMP apparatus having a polishing pad surface property measuring device configured as shown in FIGS. 1 to 4 will be described. A laser beam is emitted from the light source 31, and the laser beam is applied to the surface of the polishing pad 2. By receiving the laser beam reflected by the surface of the polishing pad 2, information of the surface of the polishing pad 2 is measured. The processor 40 converts a reflection intensity distribution obtained in the polishing pad surface property measuring device 30 to a spatial wavelength spectrum of the surface of the polishing pad by performing a Fourier transform. Further, the processor 40 arithmetically calculates the spatial wavelength spectrum to obtain a surface property value of the pad. Here, this calculation is performed by dividing a sum of reflection intensity of a predetermined spatial wavelength range by a sum of reflection intensity of a wider spatial wavelength range to obtain a surface property value of the pad.

Here, the reflection intensity distribution is defined as a distribution of the received light intensity in each light receiving position of the linear or planar light receiving element. The linear or planar CMOS element or CCD element serving as a light receiving element has a number of light receiving pixels, and can detect received light intensity on a pixel to pixel basis. The light receiving position is changed depending on a reflection angle at the time when the applied laser beam is reflected by the surface of the pad, and the received light intensity is changed depending on the surface properties of the pad. Specifically, a characteristic reflection intensity distribution corresponding to the surface properties of the pad can be obtained by capturing reflection intensities with respect to the respective reflection angles depending on the surface properties of the pad. Further, the spatial wavelength spectrum is defined as a spectrum obtained by performing a Fourier transform on the reflection intensity distribution, and shows a distribution of the received light intensity in each spatial wavelength of the pad surface. For example, in the case where the measured pad surface has a configuration comprising a combination of a wavelength A and a wavelength B primarily, the spatial wavelength spectrum has main peaks at the wavelength A and the wavelength B.

The spatial wavelength spectrum should be such that a sufficiently wide wavelength range is obtained with respect to nth-order diffracted light at the highest which includes the surface properties of the pad for determining the CMP performance. It is known that the nth-order diffracted light to be obtained is preferably seventh-order diffracted light, practically fourth-order diffracted light. In the case where the surface properties of the pad is evaluated, only the intensity of a predetermined spatial wavelength range related to the CMP performance should be extracted. However, in the obtained spatial wavelength spectrum, generally, random noise with respect to the entire wavelength range is contained. Therefore, the following approach is taken: A ratio of an integrated value of reflection intensity of a predetermined spatial wavelength range to an integrated value of reflection intensity of a wider spatial wavelength range is obtained to exclude an influence of the noise, and only the reflection intensity of the predetermined spatial wavelength range is evaluated.

In the polishing pads of IC1000 series manufactured by the Dow Chemical Company or the polishing pads of D100 series manufactured by the Cabot Corporation, the predetermined spatial wavelength range is preferably selected from a range from 2 to 15 micrometers, and the wider spatial wavelength range is preferably selected from a range from 1 to 30 micrometers. However, a preferable evaluation wavelength range is considered to be different depending on materials of the polishing pad or structures of the polishing pad, but is not limited to this wavelength range.

As described above, the ratio of an integrated value of reflection intensity of a predetermined spatial wavelength range to an integrated value of reflection intensity of a wider spatial wavelength range is obtained, and this ratio is defined as "wavelength constituent ratio" as an index for characterizing the surface properties of the pad. It shows that as the wavelength constituent ratio is larger, the reflection intensity of the predetermined spatial wavelength range is relatively larger. Thus, it shows that the measured pad surface contains more predetermined spatial wavelength component. Because it has been examined in advance that the magnitude of the predetermined spatial wavelength component has a strong connection with the CMP performance, the CMP performance can be estimated by the wavelength constituent ratio of the measured pad surface.

The dressing control unit 23 obtains a surface property value of the pad determined by the processor 40 and calculates suitable dressing conditions by a closed-loop control based on the obtained value. For example, the dressing conditions are calculated so that the surface property value of the pad remains within a preset predetermined range. In this case, the dressing control unit 23 obtains a relational expression showing a relation between the dressing conditions and the surface property value of the pad in advance and determines suitable dressing conditions by the above expression. Here, the dressing conditions mainly include a polishing pad rotational speed, a dresser rotational speed, a dressing load, a dresser swinging speed, and the like. The determined dressing conditions are transmitted to the dressing apparatus 20, and the dressing apparatus 20 performs dressing of the polishing pad 2 by applying certain dressing conditions.

For example, in the case where the dressing load is an object to be controlled as one of dressing conditions, the relationship between the dressing load and the surface properties of the pad is obtained in advance. Specifically, if the dressing load increases, how much degree the surface property value increases or decreases is obtained in advance. Then, a preset ideal surface property value of the pad and the measured surface property value of the pad are compared, and if there is a difference therebetween, the dressing load is established based on the above relationship so that the surface property value of the pad approaches the ideal surface property value of the pad.

Further, in the case where the surface property value of the pad obtained by the processor 40 is used for detection of an abnormality, the surface property value of the pad and its time-dependent change are measured, and if these values fall outside preset values, an occurrence of an abnormality of the surface properties of the pad is determined. Then, 1) An alarm of the abnormality is issued. 2) An alarm of the necessity for replacing the dresser is issued.

In one embodiment, the determination of the dressing conditions is as follows: A difference between the measured surface property value of the pad and a preset desired surface property value of the pad is obtained as a desired surface property variation of the pad, and the desired surface property variation of the pad is assigned to a regression equation prepared by obtaining in advance the relationship between a variation of at least one of a dressing load, a dresser rotational speed, a polishing pad rotational speed, and a dresser swinging speed and a surface property variation of the pad to determine at least one of the dressing load, the dresser rotational speed, the polishing pad rotational speed, and the dresser swinging speed.

According to the above embodiment, the regression equation representing the relationship between the dressing conditions (a dressing load, a dresser rotational speed, a polishing pad rotational speed, a dresser swinging speed, and the like) and the surface property value of the pad (wavelength constituent ratio) is obtained in advance, and a variation of the measured surface property value of the pad is assigned to the regression equation. Thus, optimum dressing conditions for obtaining the desired surface property value of the pad can be uniquely obtained.

The regression equation is expressed as dR=A×dL+B, for example. Here, dR represents a variation of a surface property value of the pad (wavelength constituent ratio), dL represents a variation of a dressing load, and A and B are constant.

According to the above method for determining the dressing conditions, an effect of keeping the surface properties of the pad constant from an initial stage of usage of the pad to a terminal stage of usage of the pad can be achieved. The surface properties of the pad are changed from an initial stage of usage of the pad to a terminal stage of usage of the pad by an amount of wear of the pad or a degree of sharpness of the dresser, and the CMP performance is also changed according to such change. To keep the surface properties of the pad constant leads the CMP apparatus to keep the CMP performance constant.

Further, the display unit 41 is configured to display at least one of a state of the dresser 22 and a state of the polishing pad 2 after the obtained surface property value of the polishing pad 2 and the preset surface property value of the pad are compared by the processor 40. The display unit 41 may be configured to display at least one of the state of the dresser 22 and the state of the polishing pad 2 based on the surface properties of the polishing pad 2 obtained by the processor 40 without the above comparison.

The CMP apparatus has an abnormality judgement unit for judging an abnormality of the surface properties of the polishing pad when the obtained surface property value of the polishing pad is compared with a preset range of the surface property value of the pad in the processor 40 (see FIGS. 1 and 2) and falls outside the preset range. When the abnormality is judged in the abnormality judgement unit, the display unit 41 (see FIG. 2) issues an alarm of the abnormality.

The following is typical types of the abnormality of the surface properties of the pad.

1) There are abnormal spots (defects) in the surface of the pad.

2) The dresser reaches the end of life.

3) The pad reaches the end of life.

In the case of 1), when the surface properties of the pad are measured at a plurality of spots, if there is a spot where a great difference occurs compared to other measuring spots, then such spot is judged as an abnormality of the pad and an alarm is issued.

In the cases of 2) and 3), a change in the surface properties of the pad with time (in each of the number of the processed substrates) is measured, and if the measurement falls outside the preset range, the pad is judged to reach the end of life and an alarm is issued.

As shown in FIG. 4, the polishing pad surface property measuring device 30 has the optical fiber 34, the polarizer 35, the ND filter 36, the mirror 37, the bandpass filter 38, and the like to improve the measurement accuracy further and to enhance the degree of freedom of installation. Specifically, by using the optical fiber 34, the laser beam emitted from the light source 31 can be led in a desired direction, and the degree of freedom of installation in the optical system of the polishing pad surface property measuring device 30 can be enhanced.

Further, by s-polarizing the laser beam emitted from the light source 31 with the polarizer 35 and then applying the laser beam to the polishing pad 2, the reflectance at the surface of the polishing pad can be increased. Furthermore, by using the ND filter 36, the light quantity of the laser beam can be decreased and adjusted to a desired value, and then the laser beam of the desired light quantity can be applied to the polishing pad 2. On the other hand, by providing the bandpass filter 38 on the optical path of the reflected light that is reflected by the surface of the polishing pad 2, only the reflected light having a wavelength within ±5 nm with respect to the wavelength of the laser beam of the light source 31 can pass therethrough. In the present embodiment, as a laser beam of the light source 31, a laser beam whose wavelength is 635 nm is used. In this manner, by providing the bandpass filter 38, only the reflected light having a wavelength within ±5 nm with respect to the wavelength of the laser beam of the light source 31 can pass therethrough, and thus an influence of the surrounding environment light which becomes noise can be reduced.

Figure 5:
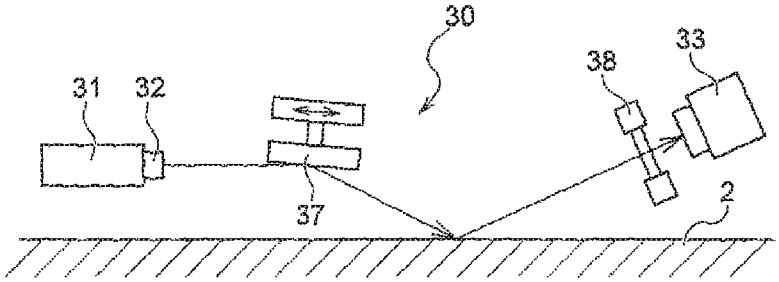
FIG. 5 is a schematic front elevational view showing a third embodiment of the polishing pad surface property measuring device shown in FIGS. 1 and 2.

FIG. 5 is a schematic front elevational view showing a third embodiment of the polishing pad surface property measuring device 30 shown in FIGS. 1 and 2. As shown in FIG. 5, the polishing pad surface property measuring device 30 includes a light source 31 for emitting a laser beam, a light emitter 32 for leading the laser beam emitted from the light source 31 in a predetermined direction, and a mirror 37 which can change an optical path by reflecting the laser beam emitted from the light emitter 32 to adjust an incident angle of the laser beam applied to the polishing pad 2. The laser beam emitted from the light source 31 is applied to the surface of the polishing pad 2 via the light emitter 32 and the mirror 37. The reflected light that is reflected by the surface of the polishing pad 2 enters the bandpass filter 38 which allows only the light having a particular wavelength range to pass therethrough, and the reflected light having the particular wavelength range is received by the light receiver 33.

Figure 6:
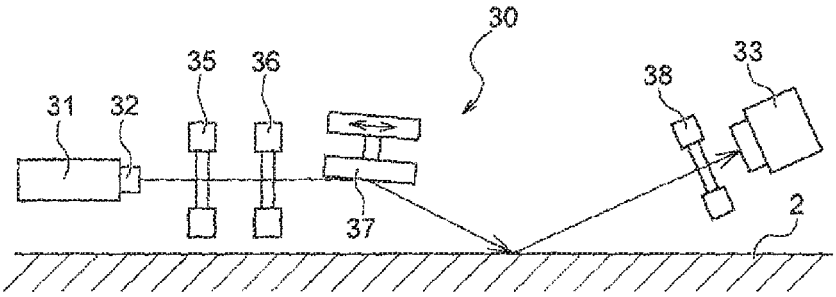
FIG. 6 is a schematic front elevational view showing a fourth embodiment of the polishing pad surface property measuring device shown in FIGS. 1 and 2.

FIG. 6 is a schematic front elevational view showing a fourth embodiment of the polishing pad surface property measuring device 30 shown in FIGS. 1 and 2. As shown in FIG. 6, the polishing pad surface property measuring device 30 has a light source 31 for emitting a laser beam, a light emitter 32 for leading the laser beam emitted from the light source 31 in a predetermined direction, and a polarizer 35, an ND filter (neutral density filter), and a mirror 37 which are arranged in series along an optical path of the laser beam emitted from the light emitter 32. The mirror 37 is configured to allow an optical path to be changeable by reflecting the laser beam emitted from the light emitter 32 to adjust an incident angle of the laser beam applied to the polishing pad 2. Further, a bandpass filter 38 is disposed before the light receiver 33 on an optical path of the reflected light that is reflected by the surface of the polishing pad 2. Therefore, the laser beam emitted from the light source 31 is s-polarized by the polarizer 35, and is then adjusted in light quantity by the ND filter 36 and applied to the mirror 37 whose angle has been adjusted in advance. Then, the laser beam is reflected by the mirror 37 to change its optical path and is then applied to the surface of the polishing pad 2. The reflected light that is reflected by the surface of the polishing pad 2 enters the bandpass filter 38 which allows only the light having a particular wavelength range to pass therethrough, and the reflected light having the particular wavelength range is received by the light receiver 33.

Figure 7:
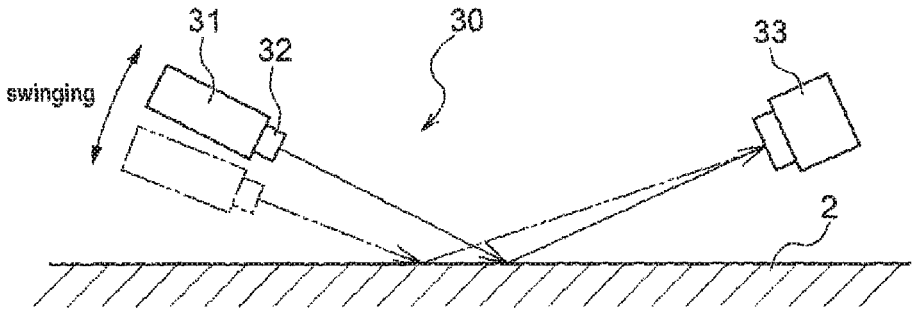
FIG. 7 is a schematic front elevational view showing a fifth embodiment of the polishing pad surface property measuring device shown in FIGS. 1 and 2.

FIG. 7 is a schematic front elevational view showing a fifth embodiment of the polishing pad surface property measuring device 30 shown in FIGS. 1 and 2 As shown in FIG. 7, the polishing pad surface property measuring device 30 has a light receiver 33 fixed in position, and a movable light source 31 which is swingable. As shown in FIG. 7, the light source 31 is configured to be swingable between a first position shown by solid lines and a second position shown by two-dot chain lines. The light source 31 may adjust an irradiation position before irradiation of the laser beam, and the position of the light source 31 may be fixed at the time of irradiation of the laser beam. Further, while swinging the light source 31, irradiation of the laser beam may be performed.

Figure 8:
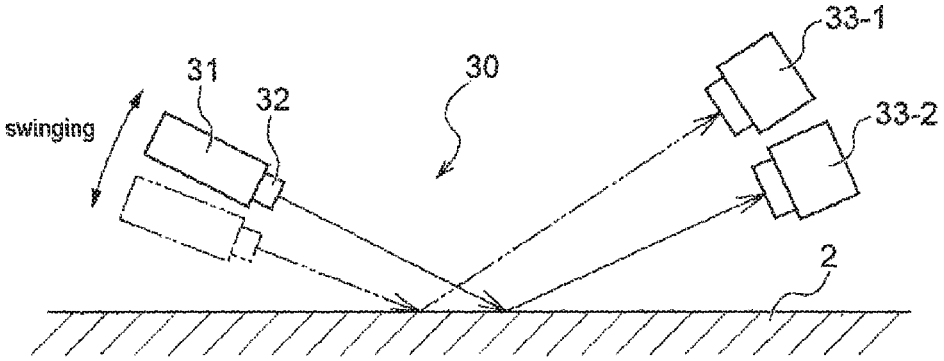
FIG. 8 is a schematic front elevational view showing a sixth embodiment of the polishing pad surface property measuring device shown in FIGS. 1 and 2.

FIG. 8 is a schematic front elevational view showing a sixth embodiment of the polishing pad surface property measuring device 30 shown in FIGS. 1 and 2. As shown in FIG. 8, the polishing pad surface property measuring device 30 has the same structure as the polishing pad surface property measuring device 30 shown in FIG. 7 except for the light receiver, and thus such same structure will not be described in duplication. In the embodiment shown in FIG. 8, two light receivers comprising a first light receiver 33-1 at an upper position and a second light receiver 33-2 at a lower position are provided. While swinging the light source 31, the laser beam is applied to the surface of the polishing pad 2. The reflected light that is reflected by the surface of the polishing pad 2 can be completely received by the two light receivers 33-1, 33-2 without any omission. Although the two light receivers are provided in the illustrated example, three or more light receivers may be provided.

Figure 9:
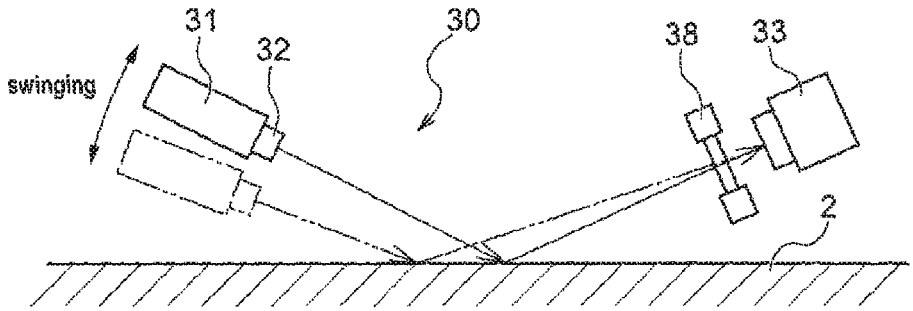
FIG. 9 is a schematic front elevational view showing a seventh embodiment of the polishing pad surface property measuring device shown in FIGS. 1 and 2.

FIG. 9 is a schematic front elevational view showing a seventh embodiment of the polishing pad surface property measuring device 30 shown in FIGS. 1 and 2. As shown in FIG. 9, the polishing pad surface property measuring device 30 has a light source 31 and a light receiver 33 which have the same structure as that of the polishing pad surface property measuring device 30 shown in FIG. 7, and thus such same structure will not be described in duplication. In the seventh embodiment, in addition to the structure of FIG. 7, a bandpass filter 38 is provided on an optical path of the reflected light that is reflected by the surface of the polishing pad 2. In this manner, by providing the bandpass filter 38, only the light having a particular wavelength range can pass therethrough, and the reflected light having the particular wavelength range is received by the light receiver 33.

Figure 10:
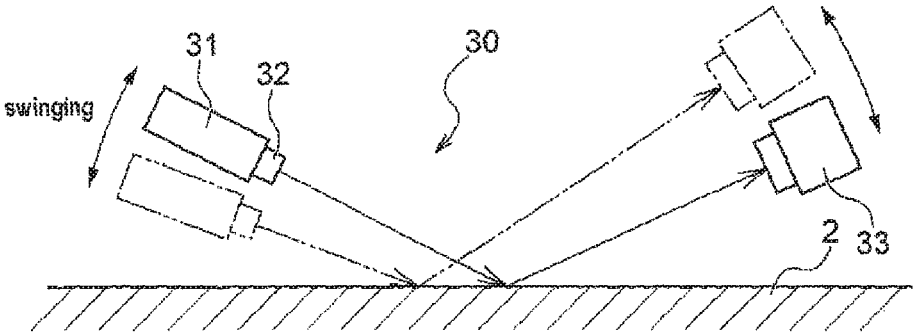
FIG. 10 is a schematic front elevational view showing an eighth embodiment of the polishing pad surface property measuring device shown in FIGS. 1 and 2.

FIG. 10 is a schematic front elevational view showing an eighth embodiment of the polishing pad surface property measuring device 30 shown in FIGS. 1 and 2. As shown in FIG. 10, the polishing pad surface property measuring device 30 has a light source 31 whose structure is the same as that of the polishing pad surface property measuring device 30 shown in FIG. 7, and thus such same structure will not be described in duplication. In the eighth embodiment, the light receiver 33 is configured to be swingable between a first position shown by solid lines and a second position shown by two-dot chain lines. Since the polishing pad surface property measuring device 30 is configured as shown in FIG. 10, while swinging the light source 31, the laser beam is applied to the surface of the polishing pad 2. Since the light receiver 33 is configured to be swingable, the reflected light that is reflected by the surface of the polishing pad 2 is received by the light receiver 33 while the light receiver 33 is swung. Thus, the reflected light is completely received by the light receiver 33 without any omission. Further, before the light source 31 applies the laser beam to the surface of the polishing pad 2, the light source 31 and the light receiver 33 are positionally adjusted, respectively. When the light source 31 applies the light beam to the surface of the polishing pad 2, the light source 31 and the light receiver 33 may be fixed in position.

Next, a computer for implementing a program for performing various processes (steps) in the CMP apparatus having the above polishing pad surface property measuring device 30 will be described.

Figure 11:
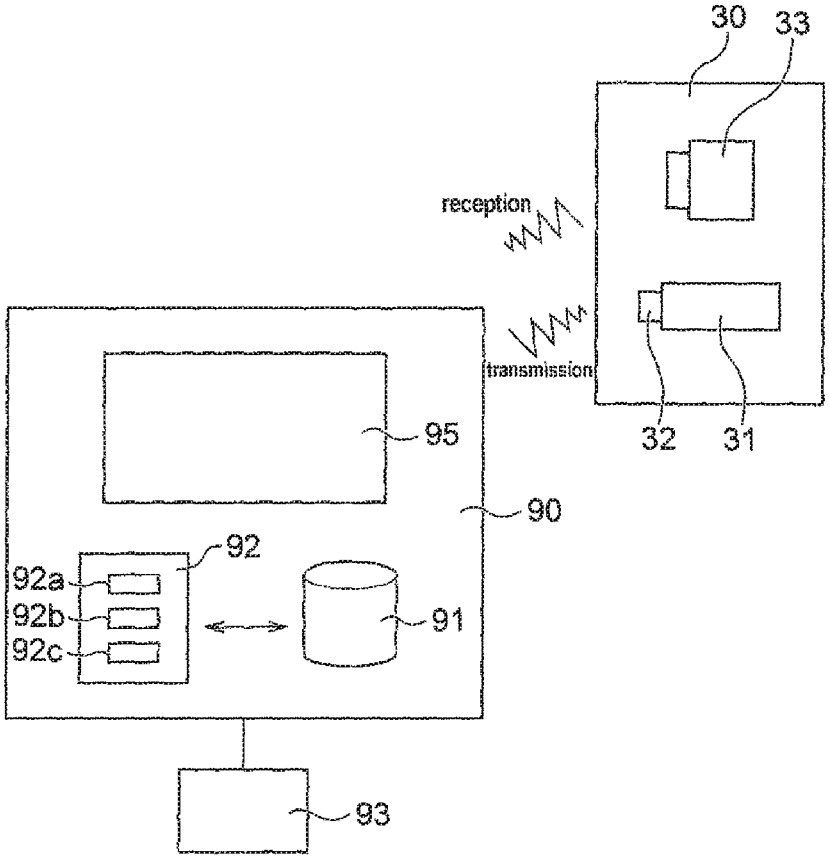
FIG. 11 is a schematic view showing an example of a computer which implements a program for detecting the state of a polishing pad or a dresser, and dressing conditions.

FIG. 11 is a schematic view showing an example of a computer 90 for implementing the program for performing various processes (steps) in the CMP apparatus. As shown in FIG. 11, the computer 90 includes a storage device 91, such as a hard disk, for storing therein the program for performing various processes (steps) in the CMP apparatus, an arithmetic device 92 for processing the program for performing various processes (steps), and an input device 93, such as a keyboard, for inputting necessary information for implementing the program for performing various processes (steps). The arithmetic device 92 includes CPU (Central Processing Unit) 92*a*, ROM (Read Only Memory) 92*b*, RAM (Random Access Memory) 92*c*, and the like. The result calculated by the arithmetic device 92 is displayed on a display device 95 which is installed on the computer 90.

The program for performing various processes (steps), which is implemented by the computer 90, may be stored into the storage device 91 from a recording medium which can be read by the computer 90, or may be stored into the storage device 91 through a communication network, such as the Internet. Examples of the computer-readable recording medium include a CD-ROM (Compact Disk Read Only Memory), a DVD (Digital Versatile Disk), an MO (Magneto Optical Disk), and a memory card.

Next, a computer-readable recording medium which records the program for causing the CMP apparatus to perform various steps (predetermined operations) will be described with reference to FIG. 12.

Figure 12:
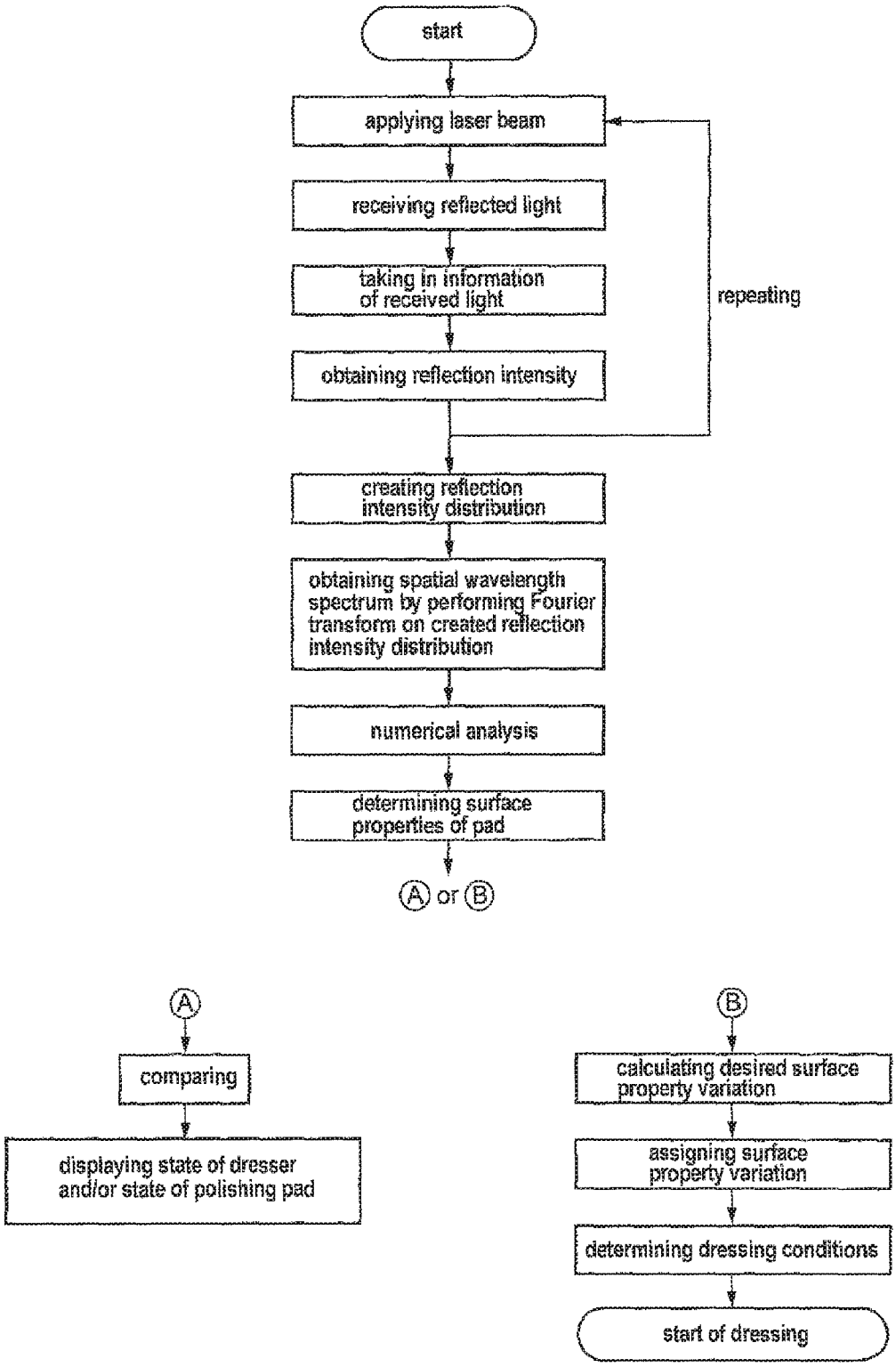
FIG. 12 is a view showing a program for causing the CMP apparatus to perform various steps (predetermined operations).

As shown in a flowchart of FIG. 12, a computer-readable recording medium which records the program for causing the CMP apparatus to perform predetermined operations records a program for causing the computer to perform the following steps: a step for applying a laser beam to a surface of a polishing pad; a step for receiving the reflected light from the polishing pad; a step for taking in information of the received light; a step for obtaining reflection intensity in each reflection angle obtained from the taken-in information; a step for creating a reflection intensity distribution by performing the step for applying the laser beam, the step for receiving the light, the step for taking in the information and the step for obtaining the reflection intensity for predetermined time; or a step for creating a reflection intensity distribution by repeating the step for applying the laser beam, the step for receiving the light, the step for taking in the information and the step for obtaining the reflection intensity a predetermined number of times; a step for obtaining a spatial wavelength spectrum of the surface of the polishing pad by performing a Fourier transform on the reflection intensity distribution; a step for performing numerical analysis from the spatial wavelength spectrum; and a step for determining surface properties of the polishing pad from the numerical analysis.

As shown in the flowchart at the lower left of FIG. 12, the recording medium records a program for causing the computer to perform further: a step for comparing the determined surface property value and a preset surface property value of the pad; and a step for displaying at least one of a state of the dresser and a state of the polishing pad from the compared result.

The recording medium records a program for executing further: a step for determining dressing conditions of the polishing pad by a closed loop control based on the determined surface property value.

As shown in the flowchart at the lower right of FIG. 12, the step for determining the dressing conditions comprises a step for obtaining a difference between the result of the surface property value obtained from the numerical analysis and a preset desired surface property value of the pad, as a desired surface property variation of the pad; a step for assigning the desired surface property variation of the pad to a predetermined regression equation which has been obtained and stored in advance; and a step for selecting optimum dressing conditions from the result of the above assignment.

The recording medium shown in FIG. 12 may record a program for causing the computer to perform further: a step for adjusting an incident angle of the laser beam to the polishing pad before the step for applying the laser beam.

Although certain preferred embodiments of the present invention have been shown and described in detail, it should be understood that various changes and modifications may be made without departing from the scope of the appended claims.

INDUSTRIAL APPLICABILITY

The present invention is applicable to a CMP apparatus having a polishing pad surface property measuring device for measuring surface properties such as surface topography or surface condition of a polishing pad used for polishing a substrate such as a semiconductor wafer.

REFERENCE SIGNS LIST

1 polishing table
1*a* table shaft
2 polishing pad
2*a* polishing surface
10 carrier
11 shaft
12 carrier arm
20 dressing apparatus
21 dresser arm
22 dresser
22*a* dressing member
23 dressing control unit
30 polishing pad surface property measuring device
31 light source
32 light emitter
33 light receiver
33-1 first light receiver
33-2 second light receiver
34 optical fiber
35 polarizer
36 ND filter (neutral density filter)
37 mirror
38 bandpass filter
40 processor
41 display unit
90 computer
91 storage device
92 arithmetic device
92*a* CPU (Central Processing Unit)
92*b* ROM (Read Only Memory)
92*c* RAM (Random Access Memory)
93 input device
95 display device

The invention claimed is:

1. A CMP apparatus comprising:

a polishing pad surface property measuring device configured to apply a laser beam to a surface of a polishing pad and to receive reflected light from the polishing pad to obtain at least one reflection intensity at a reflection angle;

a processor configured to perform a Fourier transform on a reflection intensity distribution obtained by the polishing pad surface property measuring device to obtain a spatial wavelength spectrum of the surface of the polishing pad, and to perform numerical analysis on the spatial wavelength spectrum to obtain surface properties of the polishing pad;

a dressing control unit configured to determine dressing conditions of the polishing pad by a closed loop control based on the surface properties of the polishing pad; and a dressing apparatus configured to dress the polishing pad based on the dressing conditions determined by the dressing control unit;

wherein the polishing pad surface property measuring device comprises a laser light source, a light emitter and a light receiver; and wherein the polishing pad surface property measuring device further comprises at least one of a mirror, an ND filter, a polarizer, a bandpass filter which allows transmission of only light within ±5 nm with respect to a wavelength of the laser beam emitted from the laser light source, and an optical fiber.

2. The CMP apparatus according to claim 1, wherein the determination of the dressing conditions comprises:

obtaining a difference between a measured surface property value of the pad and a preset desired surface property value of the pad, as a desired surface property variation of the pad; and assigning the desired surface property variation of the pad to a regression equation prepared by obtaining in advance a relationship between a variation of at least one of a dressing load, a dresser rotational speed, a polishing pad rotational speed, and a dresser swinging speed and a surface property variation of the pad to determine at least one of the dressing load, the dresser rotational speed, the polishing pad rotational speed, and the dresser swinging speed.

3. The CMP apparatus according to claim 1, wherein a plurality of reflection intensities obtained at a plurality of reflection angles comprises the at least one reflection intensity, and wherein the numerical analysis for obtaining the surface properties of the polishing pad performed by the processor comprises dividing a sum of the plurality of reflection intensities, wherein the reflection intensity comprises a predetermined spatial wavelength range, by a sum of the plurality of reflection intensities, wherein the reflection intensity comprises a wider spatial wavelength range.

4. The CMP apparatus according to claim 1, wherein the light receiver comprises a linear or planar CCD element or CMOS element having a size capable of receiving fourth-order diffracted light at the highest or seventh-order diffracted light at the highest of the laser beam reflected from the polishing pad.

5. The CMP apparatus according to claim 1, wherein the laser beam applied to the surface of the polishing pad is s-polarized.

6. The CMP apparatus according to claim 1, wherein the dressing control unit is configured to adjust at least one of a dressing load, a polishing pad rotational speed, a dresser rotational speed, and a dresser swinging speed.

7. The CMP apparatus according to claim 1, wherein irradiation of the laser beam is performed by swinging the laser light source to adjust an incident angle of the laser beam to the surface of the polishing pad.

8. A CMP apparatus comprising:

a polishing pad surface property measuring device configured to apply a laser beam to a surface of a polishing pad and to receive reflected light from the polishing pad to obtain reflection intensity in a reflection angle;

a processor configured to perform a Fourier transform on a reflection intensity distribution obtained by the polishing pad surface property measuring device to obtain a spatial wavelength spectrum of the surface of the polishing pad, and to perform numerical analysis on the spatial wavelength spectrum to obtain surface properties of the polishing pad; and an abnormality judgement unit configured to judge an abnormality of the surface properties of the polishing pad when a surface property value of the polishing pad obtained by the processor is compared with a preset range of the surface property value of the pad and falls outside the preset range;

wherein the polishing pad surface property measuring device comprises a laser light source, a light emitter and a light receiver; and wherein the polishing pad surface property measuring device further comprises at least one of a mirror, an ND filter, a polarizer, a bandpass filter which allows transmission of only light within ±5 nm with respect to a wavelength of the laser beam emitted from the laser light source, and an optical fiber.

9. The CMP apparatus according to claim 8, wherein when the abnormality is judged by the abnormality judgement unit, a display unit issues an alarm of the abnormality.

10. A CMP apparatus comprising:

a polishing pad surface property measuring device configured to apply a laser beam to a surface of a polishing pad and to receive reflected light from the polishing pad to obtain at least one reflection intensity at a reflection angle;

a processor configured to perform a Fourier transform on a reflection intensity distribution obtained by the polishing pad surface property measuring device to obtain a spatial wavelength spectrum of the surface of the polishing pad, and to perform numerical analysis on the spatial wavelength spectrum to obtain surface properties of the polishing pad; and a display unit configured to display at least one of a state of a dresser and a state of the polishing pad based on a result of comparison between the surface properties of the polishing pad and a preset surface property value of the pad;

wherein the polishing pad surface property measuring device comprises a laser light source, a light emitter and a light receiver; and wherein the polishing pad surface property measuring device further comprises at least one of a mirror, an ND filter, a polarizer, a bandpass filter which allows transmission of only light within ±5 nm with respect to a wavelength of the laser beam emitted from the laser light source, and an optical fiber.

11. The CMP apparatus according to claim 10, wherein the state of the dresser is one of an alarm representing life of the dresser and a poor performance state of the dresser.

12. The CMP apparatus according to claim 10, wherein the state of the polishing pad is presence or absence of an abnormality of the surface properties of the polishing pad.

13. A CMP apparatus comprising:

a polishing pad surface property measuring device configured to apply a laser beam to a surface of a polishing pad and to receive reflected light from the polishing pad to obtain reflection intensity in a reflection angle;

a processor configured to perform a Fourier transform on a reflection intensity distribution obtained by the polishing pad surface property measuring device to obtain a spatial wavelength spectrum of the surface of the polishing pad, and to perform numerical analysis on the spatial wavelength spectrum to obtain surface properties of the polishing pad; and a display unit configured to display at least one of a state of a dresser and a state of the polishing pad based on the surface properties of the polishing pad;

wherein the polishing pad surface property measuring device comprises a laser light source, a light emitter and a light receiver; and wherein the polishing pad surface property measuring device further comprises at least one of a mirror, an ND filter, a polarizer, a bandpass filter which allows transmission of only light within ±5 nm with respect to a wavelength of the laser beam emitted from the laser light source, and an optical fiber.

14. The CMP apparatus according to claim 13, wherein the state of the dresser is dressing capability of the dresser.

15. The CMP apparatus according to claim 13, wherein the state of the polishing pad is a surface property value of the polishing pad.

16. A computer-readable recording medium which records a program for causing a CMP apparatus according to claim 1 to perform predetermined operations, the recording medium which records the program causing a computer to perform:

a step for applying a laser beam to a surface of a polishing pad;

a step for receiving reflected light from the polishing pad;

a step for retrieving information of the received light;

a step for obtaining reflection intensity in each reflection angle obtained from the retrieved information;

a step for creating a reflection intensity distribution by performing the step for applying the laser beam, the step for receiving the light, the step for retrieving the information and the step for obtaining the reflection intensity for a predetermined time; or a step for creating a reflection intensity distribution by repeating the step for applying the laser beam, the step for receiving the light, the step for retrieving the information and the step for obtaining the reflection intensity a predetermined number of times;

a step for obtaining a spatial wavelength spectrum of the surface of the polishing pad by performing a Fourier transform on the reflection intensity distribution;

a step for performing numerical analysis from the spatial wavelength spectrum; and a step for obtaining surface properties of the polishing pad from the numerical analysis.

17. The computer-readable recording medium according to claim 16, wherein the recording medium records the program causing the computer to perform further:

a step for comparing a surface property value obtained from the numerical analysis and a preset surface property value of the pad; and a step for displaying at least one of a state of a dresser or a state of the polishing pad obtained from the step for comparing.

18. The computer-readable recording medium according to claim 16, wherein the recording medium records the program causing the computer to perform further:

a step for determining dressing conditions of the polishing pad by a closed loop control based on the obtained surface property value.

19. The computer-readable recording medium according to claim 18, wherein the step for determining the dressing conditions comprises:

a step for obtaining a difference between a surface property value obtained from the numerical analysis and a preset desired surface property value of the pad, as a desired surface property variation of the pad;

a step for assigning the desired surface property variation of the pad to a predetermined regression equation which has been obtained and stored in advance; and a step for selecting optimum dressing conditions from a result obtained by the step for assigning the desired surface property variation of the pad to the predetermined regression equation.

20. The computer-readable recording medium according to claim 16, wherein the recording medium records the program causing the computer to perform further:

a step for adjusting an incident angle of the laser beam to the polishing pad before the step for applying the laser beam.

* * * * *